US006219001B1

(12) United States Patent
Sugawara et al.

(10) Patent No.: US 6,219,001 B1
(45) Date of Patent: Apr. 17, 2001

(54) TAPERED SLOT ANTENNA HAVING A CORRUGATED STRUCTURE

(75) Inventors: Satoru Sugawara; Koji Mizuno, both of Sendai (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/466,796

(22) Filed: Dec. 20, 1999

(30) Foreign Application Priority Data

Dec. 18, 1998 (JP) ..... 10-375826

(51) Int. Cl.[7] ..... H01Q 13/10
(52) U.S. Cl. ..... 343/767; 343/768; 343/770
(58) Field of Search ..... 343/767, 768, 343/769, 770, 771; H01Q 13/10

(56) References Cited

U.S. PATENT DOCUMENTS 6,008,770 * 12/1999 Sugawara ..... 343/767
6,075,493 * 6/2000 Sugawara et al. ..... 343/767

OTHER PUBLICATIONS

Satoru Sugawara et al, "Characteristics of a MM–Wave Tapered Slot Antenna With Corrugated Edges," Digest of IEEE MTT–S International Microwave Symposium, 1998, pp. 533–536.

Pranay R. Acharya, et al, "Slotline Antennas for Millimeter and Submillimeter Wavelengths", Proc. 20$^{th}$Euro. Microwave Conf., Budapest, Hungary, Sep., 1990, pp. 353–358.

* cited by examiner

*Primary Examiner*—Don Wong
*Assistant Examiner*—Hoang Nguyen
(74) *Attorney, Agent, or Firm*—Oblon, Spivak, McClelland, Maier & Neustadt, P.C.

(57) ABSTRACT

A tapered slot antenna is provided including a substrate and a metal layer which is disposed on the substrate and removed in a region to form a tapered slot portion having a closed narrow end and extending outward toward a relatively wider end that is open. The tapered slot antenna is further provided with a corrugated structure including a plurality of slits formed periodically positioned in opposing outer edge portions of the metal layer parallel to the direction of the radiation by removing rectangular portions of the metal layer, having a sit depth ranging from 0.04 wavelengths to 0.12 wavelengths. With the structure, an electric field component can adequately be generated to thereby reduce the cross-polarized D-plane component and the electric field intensity at the substrate edge portions as well.

18 Claims, 24 Drawing Sheets

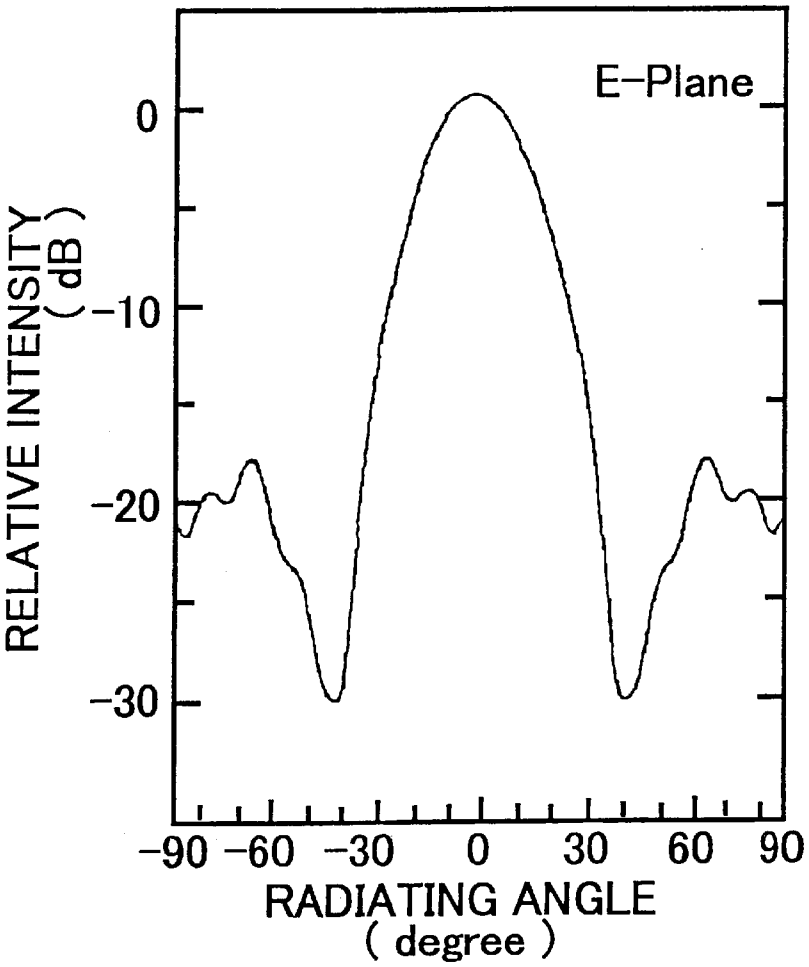
FIG. 5A *PRIOR ART*

TAPERED SLOT ANTENNA HAVING A CORRUGATED STRUCTURE

BACKGROUND OF THE INVENTION

1. Field of the Invention

The present invention relates to a tapered slot antenna for use in high-frequency transmission, and more particularly, to a tapered slot antenna provided with a corrugated structure, having an improved directivity, for use in mobile communication equipment, small information terminals, etc.

2. Description of the Background

Tapered slot antennas have a number of potential applications as single elements and focal plane arrays. They have important advantages such as being light in weight, less expensively manufactured with printed circuit board techniques that are capable of accurate replication from unit to unit.

FIG. 10 is a perspective view for exemplifying such a known tapered slot antenna. Referring to FIG. 10, the tapered slot antenna 100 includes a substrate 120 and a metal layer 130 disposed thereon.

The substrate 120 is made of a dielectric material such as polyimide, having a thickness of 10 to 100 microns. In addition, the metal layer 130 preferably made of copper has a thickness of 2 to 20 microns, with a tapered portion 14 etched away to expose a portion of the dielectric substrate 120. This tapered portion 14 extends outward toward the aperture 15 of the slot antenna 100.

The tapered slot antenna radiates the electromagnetic wave to the direction parallel to the antenna plane (that is, along a slot line). Since the tapered slot antenna has a structure similar to that of a slot line without requirements for a grounded conductor on the backside thereof unlike the micro strip line, it can be integrated more easily with various components such as, for example, feeder lines and matching circuits in a uniplanar structure.

In addition, since the tapered slot antenna has a broad band of transmission frequency and a high antenna gain, it is adequately used in mobile communication equipment, small information terminal and other wireless communication apparatuses.

For the known tapered slot antenna 100, it is found that the D-plane cross-polarized component generally has a magnitude of as large as −6 dB to −9 dB. Referring to FIG. 11, the E- and H-planes of the tapered slot antenna are defined, respectively, as the planes which each includes the direction of radiation, and which is in parallel and in perpendicular to the surface plane of the antenna substrate 120. In addition, the D-plane is defined as that which makes a 45° angle between both the E- and H-planes. Further, a cross-polarized wave is the electromagnetic wave which is polarized perpendicular to the polarization direction of the antenna.

A method of reducing the magnitude of a D-plane cross-polarized component is described by P. R. Acharya, J. Johansson and E. L. Kollberg, entitled SLOTLINE ANTENNA FOR MILLIMETER AND SUB-MILLIMETER WAVELENGTH, Proc. 20th Euro. Microwave Conf., Budapest, Hungary, pp. 353–358, September, 1990.

According to this publication, the magnitude of D-plane cross-polarized component can be reduced to −11 dB by fabricating a broken linearly tapered slot antenna (BLTSA). The tapered portion of this slot antenna has the shape composed of three compositional linear portions, each having consecutively different gradient.

This publication, however, does not detail further concerning the reasons why and how the D-plane cross-polarized component can be reduced. It is difficult, therefore, to fabricate such a slot antenna as above according to the description.

As indicated above, the D-plane cross-polarized component is large for the known tapered slot antenna. This gives rise to disadvantages for use in receiving more than one component, as exemplified hereinbelow: An antenna system is consisted of two tapered slot antennas with each slot line directed to the same direction and each antenna plane in perpendicular to each other to receive two polarized components separately. Because of the above-mentioned large intensity of D-plane cross-polarized component, one antenna in this system is sensitive not only to the component parallel to its own plane but also to the component perpendicular to its plane. Therefore, two polarized components can not be satisfactorily separated with the above antenna system.

In addition, the reasons for the aforementioned large magnitude of the D-plane cross-polarized component are yet to be clarified.

SUMMARY OF THE INVENTION

It is therefore an object of the present disclosure to provide an improved tapered slot antenna, which overcomes the above-noted difficulties.

It is another object of the present disclosure to provide a tapered slot antenna, having a reduced magnitude of its D-plane cross-polarized component and an improved directivity, with clarifying the reasons for a large magnitude of the D-plane component.

To achieve the foregoing and other objects, and to overcome the shortcomings discussed above, a tapered slot antenna is provided including a substrate and a metal layer which is disposed on the substrate and removed in a region to form a tapered slot portion having a closed narrow end and extending outward toward a relatively wider end that is open. The tapered slot portion radiates the electromagnetic wave from the wider end. In addition, the tapered slot antenna also includes an electric field generating means for generating an electric field which counteracts a field component radiated from the end portion of the tapered slot perpendicular to the substrate. The electric field generating means is formed in outside edge portions of the substrate, having the distances of within 0.65 wavelengths between the edge of the wide end and an outside edge of the substrate.

According to one aspect disclosed herein, the electric field generating means in the tapered slot antenna comprises a corrugated structure which includes a plurality of slits formed periodically in opposing outer edge portions of the metal layer parallel to the direction of the radiation, having a slit depth ranging from 0.04 wavelengths to 0.12 wavelengths.

According to another aspect disclosed herein, the electric field generating means in the tapered slot antenna comprises a corrugated structure and a plurality of linear slits. The corrugated structure includes a plurality of slits formed periodically positioned in opposing outer edge portions of the metal layer parallel to the direction of the radiation, having a slit depth of the corrugate structure of at least 0.15 wavelengths. In addition, the linear slits are additionally formed in the metal layer between the tapered portion and the corrugate structure parallel to the direction of the radiation.

With these structures of the tapered slot antenna disclosed herein including the corrugated structure, an electric field component can adequately be generated so as to reduce the cross-polarized D-plane component and the electric field intensity at the substrate edge portions as well.

BRIEF DESCRIPTION OF THE DRAWINGS

Preferred embodiments will be described in detail with reference to the following drawings in which like reference numerals refers to like elements and wherein:

FIGS. 5A, 5B and 5C show the directivity measurement results of the radiation intensity in the E-, H-, and D-planes for a prior tapered slot antenna;

DESCRIPTION OF THE PREFERRED EMBODIMENTS

Figure 10:
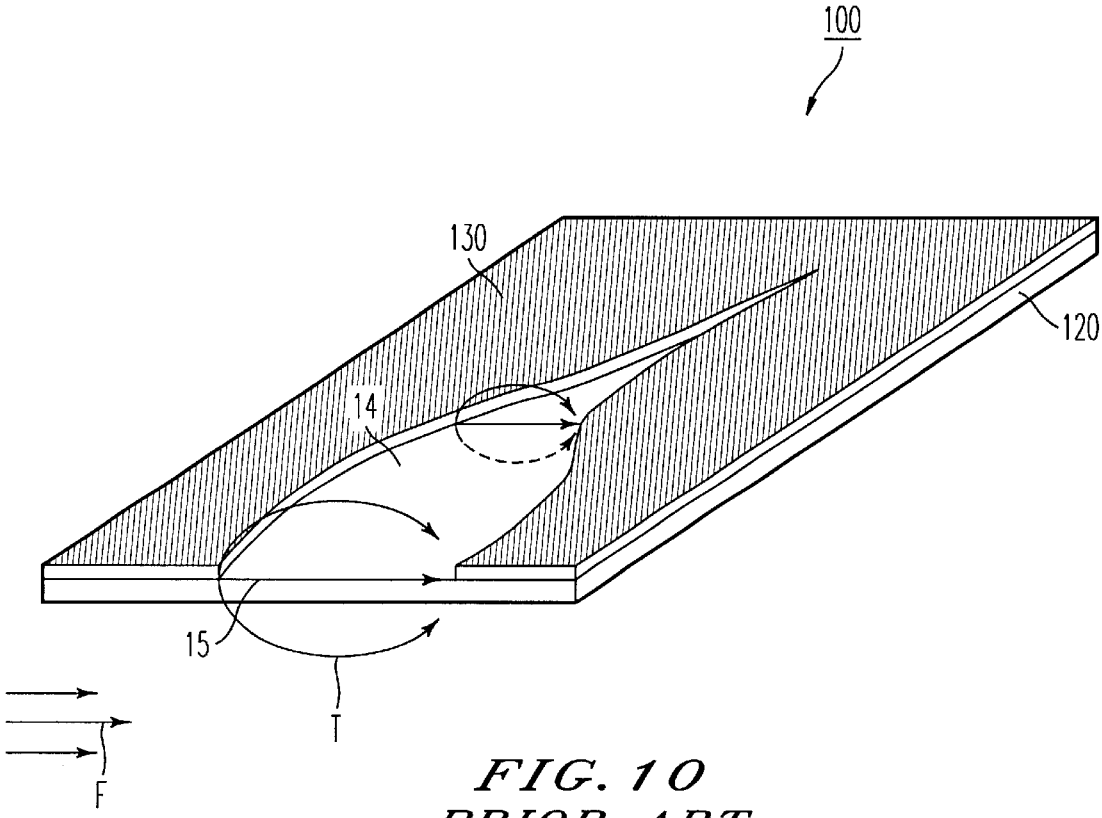
FIG. 10 PRIOR ART
FIG. 10 is a perspective view illustrating a prior tapered slot antenna.
Figure 11:
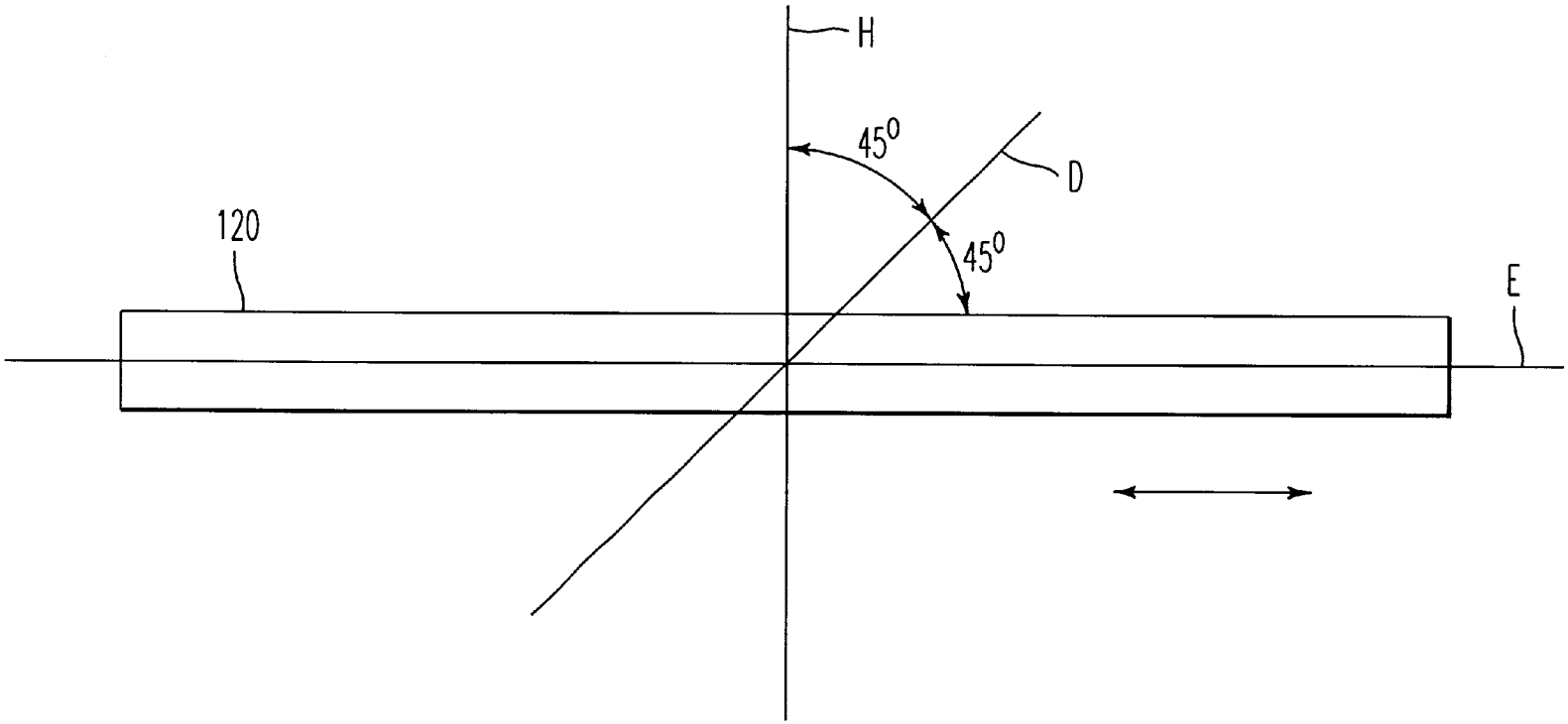
FIG. 11 is a side view illustrating an antenna, wherein the E-, H-, and D-planes are shown.
Figure 12:
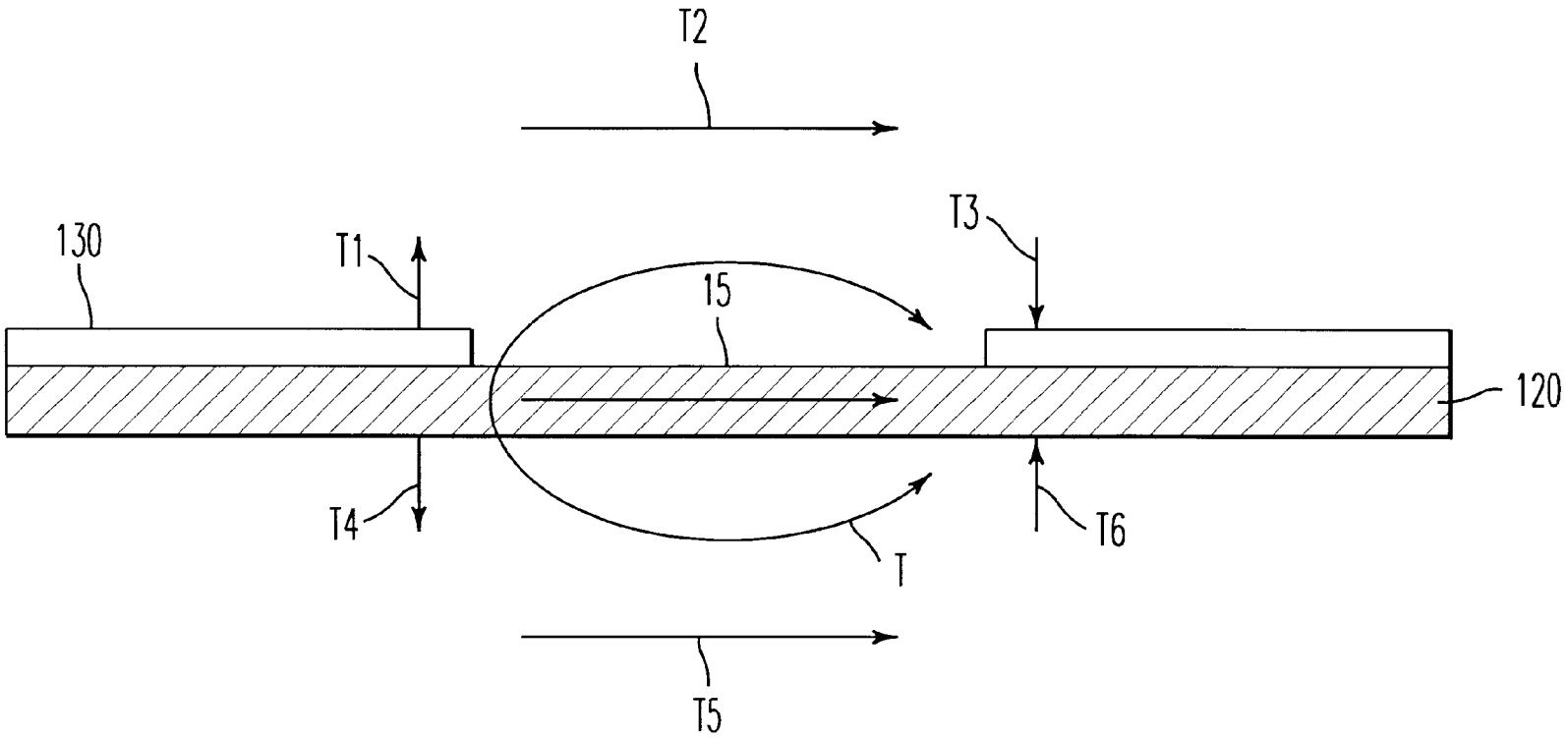
FIG. 12 PRIOR ART
FIG. 12 is a side view illustrating a prior tapered slot antenna of FIG. 10 facing the aperture along the slot line.

FIGS. 10 is a perspective view of a known tapered slot antenna 100 and FIG. 12 is a side view of the slot antenna of FIG. 10 facing the aperture 15 along the slot line.

Being radiated from a tapered slot antenna 100, the electromagnetic wave is transferred from a traveling wave mode T to a free space mode F, as shown in FIGS. 10 and 12.

Referring to FIG. 12, the traveling wave mode T may be decomposed into components T1, T3, T4 and T6 perpendicular to, and components T2 and T5 parallel to the substrate 120.

Since these perpendicular components are included as above, they are radiated also into free space to result in cross-polarized components.

Since the perpendicular components are highly symmetric with respect to either the E-plane (horizontal direction in FIG. 12) or the H-plane (vertical direction in FIG. 12), they offset one another.

With respect to the E-plane, for example, since the components T1 and T4 (or T3 and. T6) have the same magnitude with the opposite sense and are located at the same distance, the radiation field is therefore canceled along the E-plane. With respect to the H-plane in a similar manner to above, since the components T1 and T3 (or T4 and T6) also have the same magnitude with the opposite sense and are located at the same distance, the radiation field is canceled along the H-plane. The cross-polarized components in the E- and H-planes are, therefore, not greatly intensified, thereby causing no appreciable effects.

In contrast, since the perpendicular components are less symmetric with respect to the D-plane (45° tilted direction in FIG. 12), cross-polarized components may have an appreciable intensity along the H-plane.

Therefore, means for generating an electric field are disclosed in the following embodiments, for generating an electric field so as to counteract the perpendicular electric field component of the electromagnetic wave radiated from the aperture, to thereby adequately reduce the cross-polarized D-plane intensity.

Figure 1A:
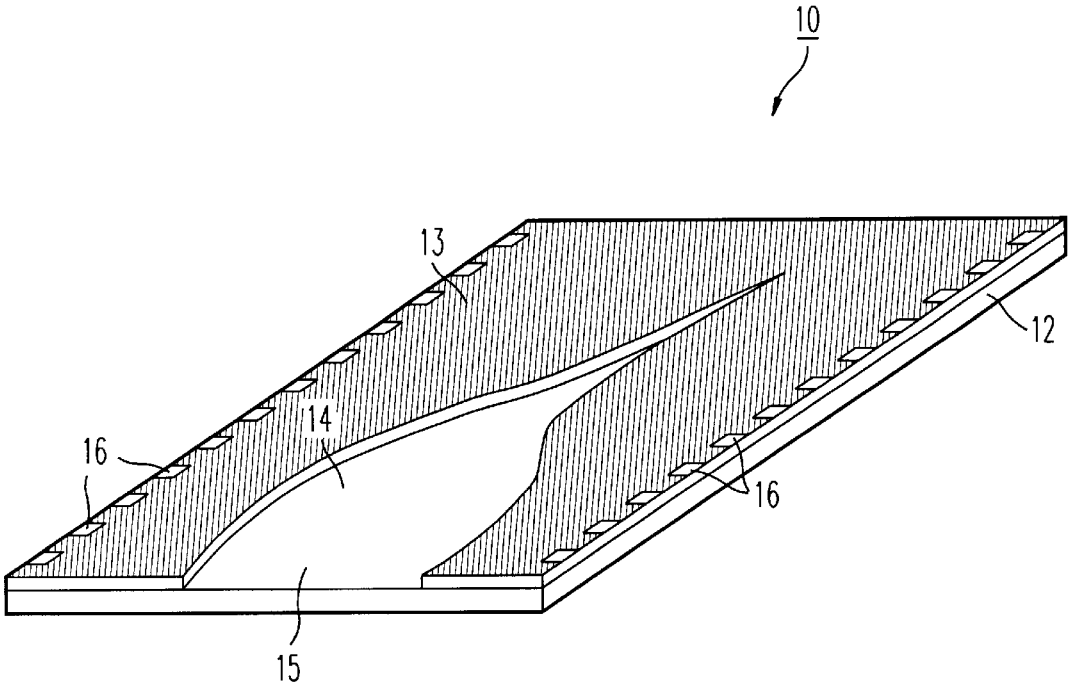
FIGS. 1A and 1B are perspective and top views illustrating a tapered slot antenna, respectively, according to one embodiment disclosed herein.
Figure 1B:
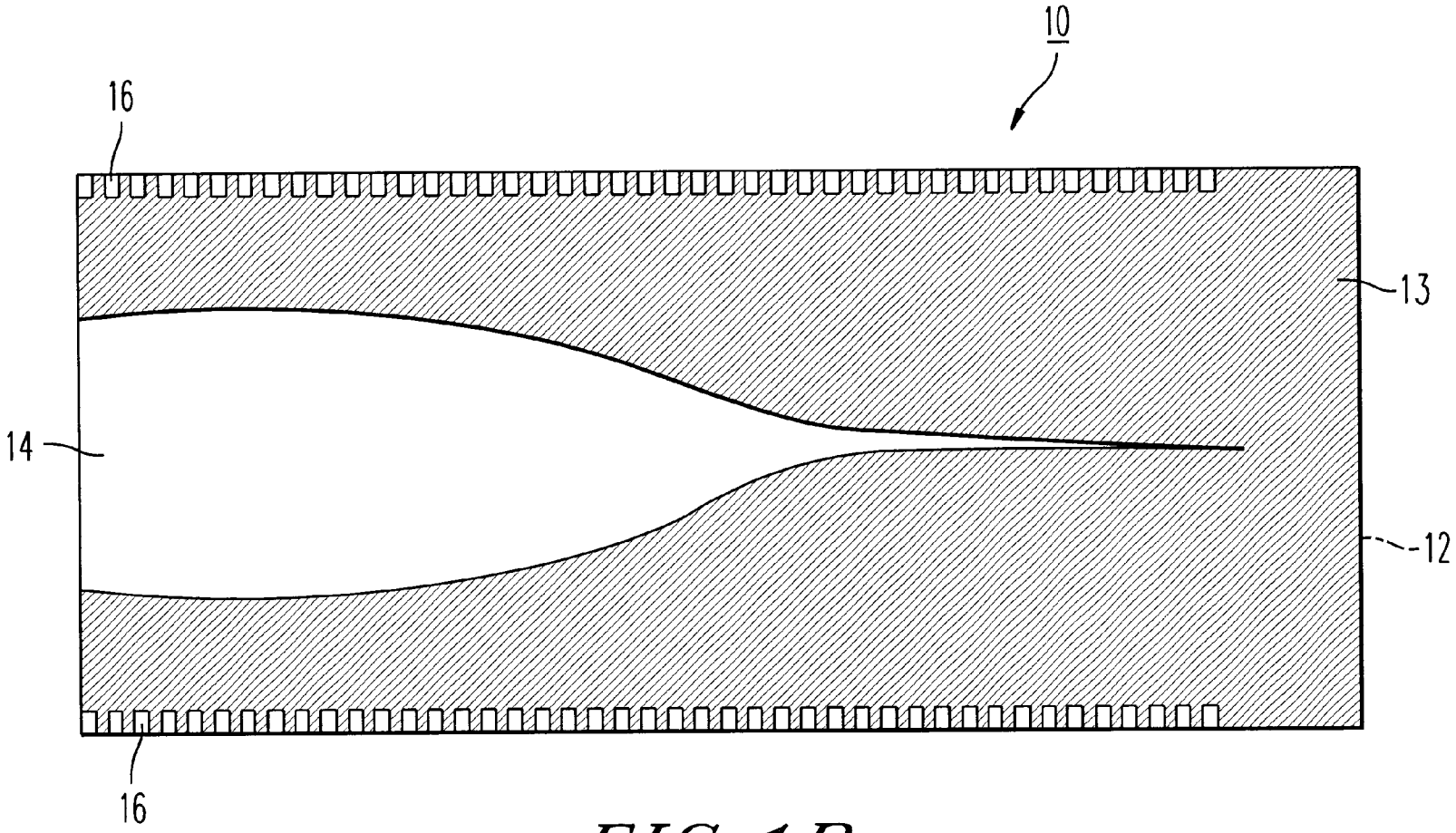

FIGS. 1A and 1B are perspective and top views of a tapered slot antenna, respectively, according to a first embodiment of the invention.

Referring to FIGS. 1A and 1B, a tapered slot antenna 10 comprises a substrate 12 and a metal layer 13 disposed thereon. The substrate 12 is preferably made of a dielectric material such as polyimide (Kapton™ from Du Pont de Nemours, for example), having a thickness of 10 to 100 microns. In addition, the metal layer 13 preferably made of copper, as major ingredients, has a thickness of 2 to 20 microns, with a tapered portion 14 etched away to expose a portion of the dielectric substrate 12. This tapered portion 14 extends toward the aperture 15 of the slot antenna 10.

On the opposing edge portions of the metal layer 13, which are located in the outer edges of the substrate 12 and not including the aperture 15, a corrugated structure 16 is formed as shown in FIGS. 1A and 1B, having a plurality of slits periodically provided on these edge portions.

The use of such a corrugated structure for controlling the phase and intensity of the electric field is described by the present inventors and others (i.e., S. Sugahara, Y. Mita, K. Adachi, K. Mori and K. Mizuno, IEEE MTT-S International Microwave Symposium Digest, 1998, pages 533–536). It is described in this publication that an electric field component can adequately be radiated with this corrugated structure of FIGS. 1A and 1B, so as for the electric field component to counteract on a perpendicular component (i.e., component perpendicular to the substrate) of the electromagnetic wave radiated from the aperture portion 15 of the antenna 10.

Figure 2:
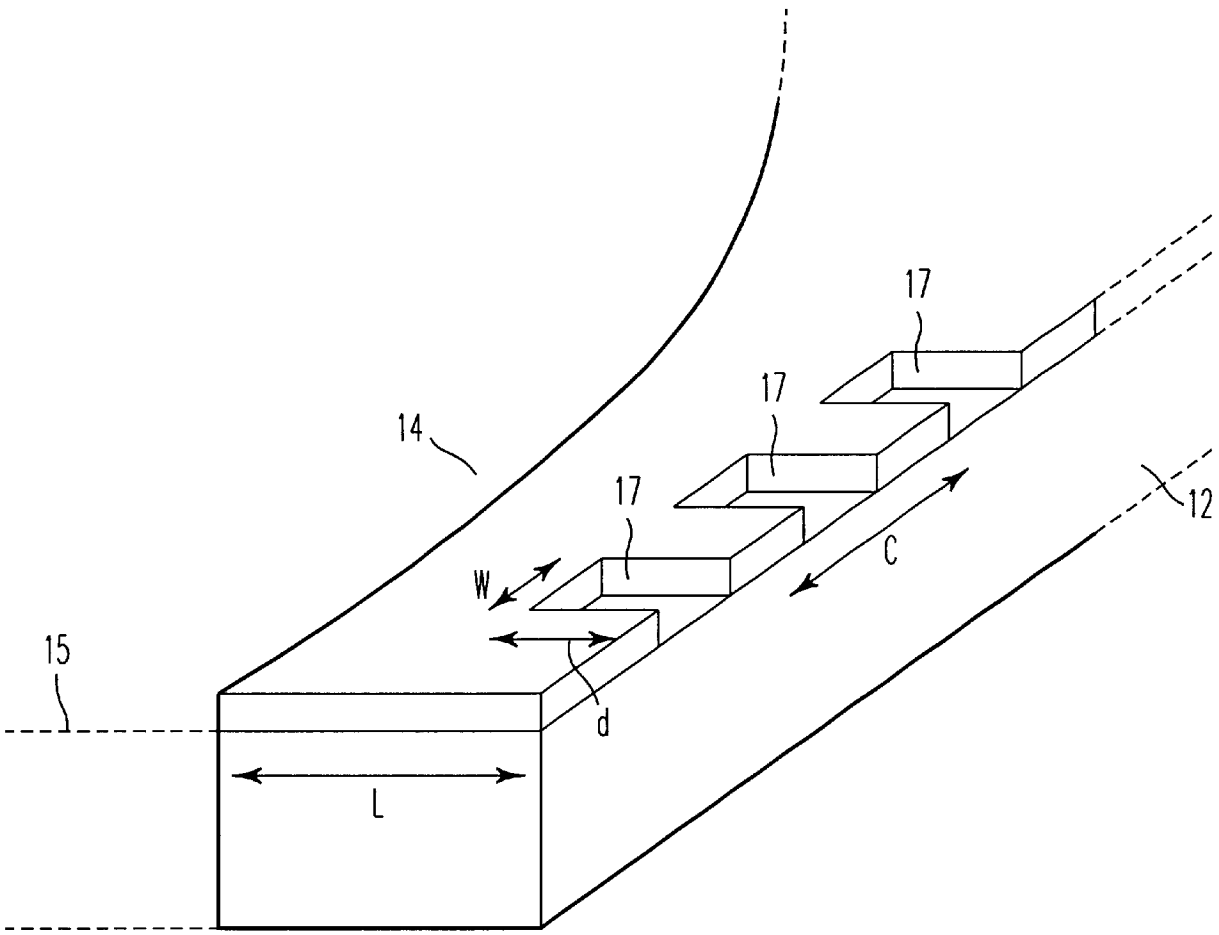
FIG. 2 is an enlarged view illustrating a portion of a tapered slot antenna according to one embodiment disclosed herein.

FIG. 2 is an enlarged view illustrating a portion of a tapered slot antenna 10 according to a first embodiment disclosed herein, provided with a corrugated structure 16. Referring to FIG. 2, the corrugated structure 16 includes a plurality of slits 17 cut into the opposing outer edge portions of the metal layer 13. These slits are formed periodically by removing rectangular portions of the metal layer 13, having predetermined depth, width and pitch. As also shown in FIG. 2, the parameters d, w and c represent the depth, width and pitch of the slit 17, respectively. In addition, the parameter L represents the distance between the edge of the aperture 15 and the outer edge of the slot antenna 10.

A tapered slot antenna radiates the electromagnetic wave to the direction parallel to the antenna plane (that is, along the slot line). This capability is adequately utilized, when the antenna is incorporated in mobile communication equipment, small information terminal and other wireless communication apparatuses.

A variety of tapered slot antennas were fabricated and then subjected to various measurements of characteristic parameters in order to reduce cross-polarized components in the D-plane. Namely, a copper metal layer 13 was disposed having a thickness of about 5 microns, on a Kapton™ substrate 12 having a thickness of about 50 microns. Subsequently, three kinds of antennas d4cw04, d5cw04 and d5cw08, were fabricated having fundamental antenna parameters such as an antenna length of 20 millimeters and an antenna aperture of 5 millimeters.

As to the aforementioned parameter L which represents the distance between the aperture edge and the outer edge of the antenna, the following values were selected such as, 2 millimeters (i.e., 0.4 wavelengths) for the antenna d4cw04, having the symbol prefixed by d4, and 2.5 millimeters (0.5 wavelengths) for the antennas d5cw04 and d5cw08, each having the symbol prefixed by d5.

In addition, the slit width w and slit pitch c were selected, respectively, to be 0.2 millimeters (0.04 wavelengths) for the antennas d4cw04 and d5cw04, each having the symbol suffixed by cw04, for the antenna dScw08, having the symbol suffixed by cw08. Further, the slit depth d was varied for respective antennas d4cw04, d5cw04 and d5cw08.

The measurements related to the intensity were carried out at 60 GHz (5 mm in wavelengths). The results from the measurements are shown in FIG. 3A, in which the intensity (in dB) of cross-polarized D-plane components on the ordinate is plotted versus the pitch depth d, normalized to the wavelengths, on the abscissa.

The cross-polarized D-plane intensity was obtained larger than −10 dB for d value of 0 to 0.04 wavelengths for all three antennas. The intensity decreases rapidly with the increase in d for the range of 0.04 wavelengths to 0.12 wavelengths, and the lowest intensity of −7.5 dB was obtained for the antenna d4cw04, in particular. For d value of ranging from 0.12 wavelengths to 0.2 wavelengths, the intensity larger than −10 dB was obtained again for all antennas.

Figure 3A:
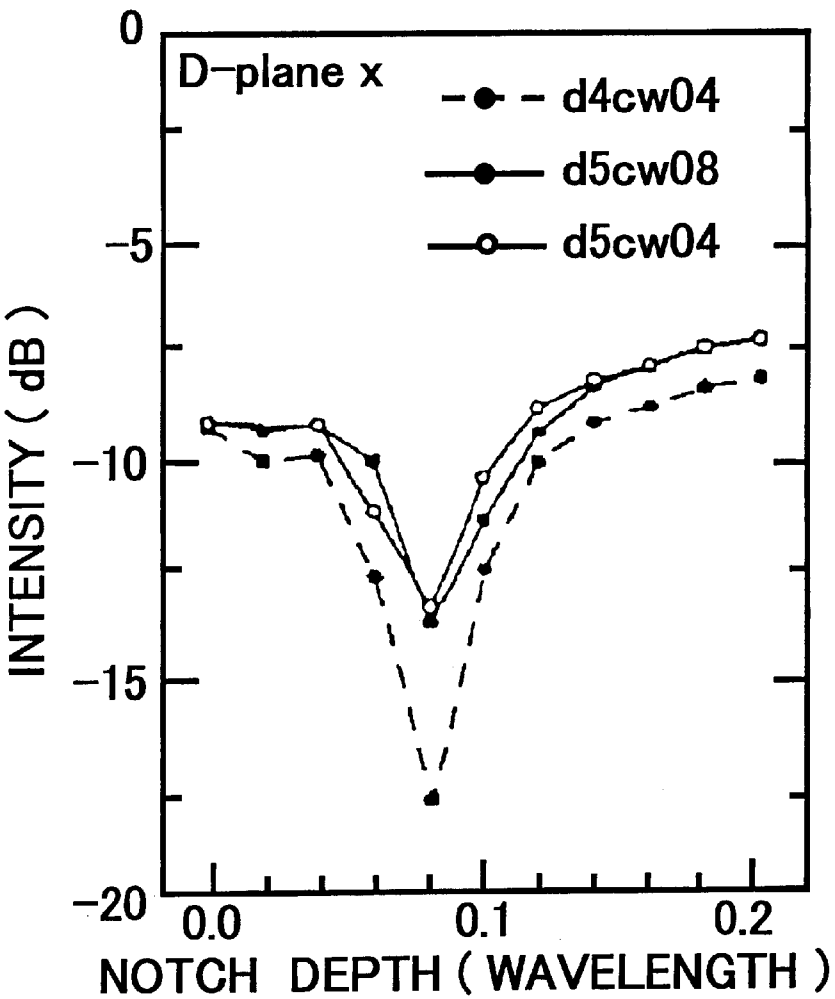
FIG. 3A shows the intensity measurement results of cross-polarized component in the D-plane of tapered slot antennas according to one embodiment disclosed herein.

As indicated in FIG. 3A, the cross-polarized D-plane intensity is decreased considerably for the d value ranging from 0.06 wavelengths to 0.1 wavelengths. Accordingly, the tapered slot antenna according to the first embodiment is fabricated including a corrugated structure 16 with a slit depth preferably ranging from 0.04 wavelengths to 0.12 wavelengths, more preferably from 0.06 wavelengths to 0.1 wavelengths. With the present structure of the corrugate structure, the reduction in the cross-polarized D-plane intensity can be achieved for the tapered slot antenna 10.

This reduction in the cross-polarized D-plane intensity in the tapered slot antenna is attained as follows. First, by acting with the corrugated structure 16 to reverse the phase, then to enhance the intensity, of the electric field at the edge portion of the substrate; and second, by generating an electric field in the vicinity of the aperture portion 15, having the phase opposite to that of the perpendicular component (i.e., component perpendicular to the substrate) of the electric field radiated from the aperture 15; the cross-polarized D-plane intensity is then adequately reduced by superposing the above two components.

Another set of tapered slot antennas were fabricated and subsequently subjected to measurements to determine an optimum value of the distance L between the edge of the aperture 15 and the outer edge of the slot antenna 10.

Namely, a copper metal layer 13 was disposed having a thickness of about 5 microns, on a Kapton™ substrate 12 having a thickness of about 50 microns. Subsequently, the antennas were formed, which are each various in the distances L between the edge of the aperture and outer edge of the antenna, and has the fundamental antenna parameters such as an antenna length of 20 millimeters and antenna aperture of 5 millimeters. In addition, the antennas were provided in both edge portions with a corrugated structure having a slit depth d of 0.4 millimeters (0.08 wavelengths), a slit width w of 0.2 millimeters (0.04 wavelengths, and a pitch of 0.4 millimeters (0.08 wavelengths).

With the thus formed antennas, the cross-polarized intensity in the D-plane was measured for each antenna with various L values. The measurements were carried out at 60 GHz (5 mm in wavelength) to obtain the results shown in FIG. 3B, in which the intensity (dB) of cross-polarized D-plane components on the ordinate is plotted versus the distances L between the aperture edge and slot edge, normalized to free space wavelength.

Figure 3B:
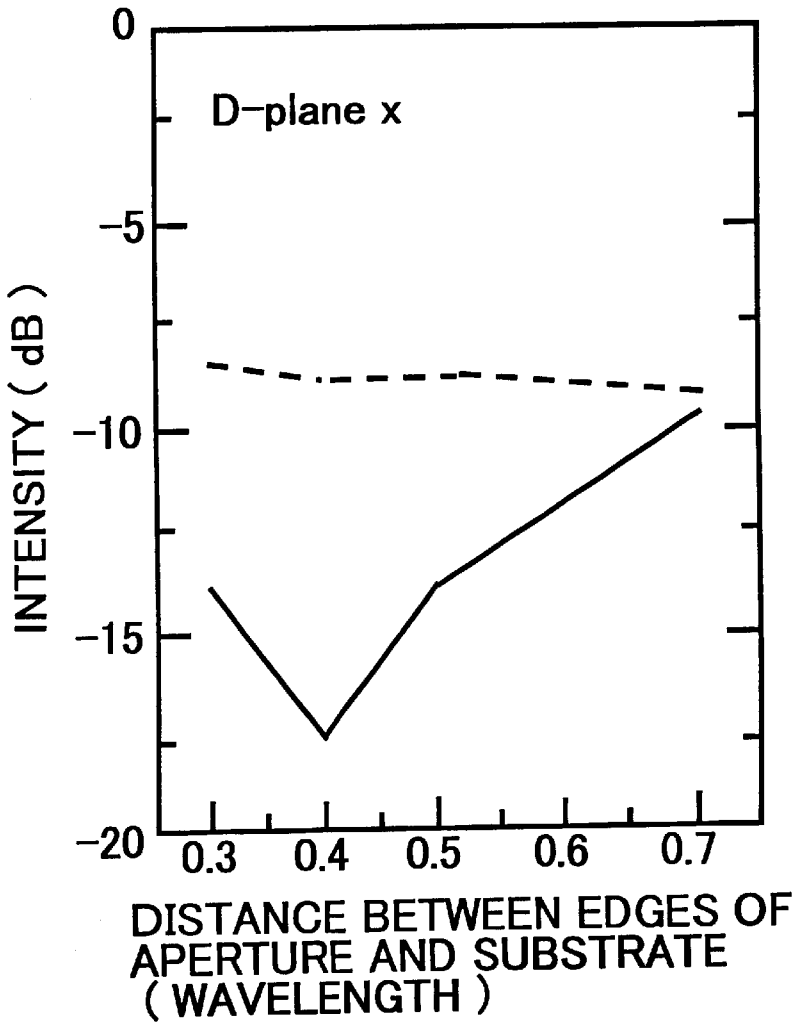
FIG. 3B shows the intensity measurement results of cross-polarized component in the D-plane with various distances between the aperture edge and slot edge, for a tapered slot antenna according to one embodiment disclosed herein and for a prior tapered slot antenna.

There also shown in FIG. 3B for comparison are the results obtained for a prior antenna without a corrugate structure. The latter results are shown by the dotted curve in FIG. 3B, while the results from the measurements of presently embodied antenna are shown by the solid curve, which are related to the antenna provided with the corrugated structure mentioned above.

For the tapered slot antenna with the corrugated structure disclosed herein, it is shown in FIG. 3B that the intensity of cross-polarized D-plane component decreases gradually with the increase in the L value ranging from 0.3 to 0.4. This results in a lowest intensity of approximately −17.5 dB at around 0.4 wavelengths, then gradually increases with the increase in the L value ranging from 0.4 wavelengths to 0.7 wavelengths. For the prior antenna noted above, however, the intensity of cross-polarized D-plane component remains almost constant throughout the L values in the above range.

In addition, it is shown in FIG. 3B that the intensity of cross-polarized D-plane component for the tapered slot antenna disclosed herein is lower than that of the known antenna throughout the L values in the above range. It is also shown that the intensity of cross-polarized D-plane component for the tapered slot antenna is adequately decreased for L values in the range of 0.6 wavelengths or below.

Incidentally, it is known that the electric field radiated electromagnetic wave is, in general, distributed primarily within the spatial range of four tenths of its wavelength toward the outside of the tapered portion. Therefore, it may be assumed that a corrugated structure needs to be formed at least within the distance of one quarter wavelength from the edge of the tapered portion 14 in order for an electric field component to adequately be generated and to counteract on the electric field component.

Therefore, it is considered that the corrugated structure in the present embodiment is preferably formed within the distance of 0.65 wavelengths from the edge of the tapered portion 14.

The results shown in FIG. 3B appear to confirm the aforementioned requirements for the desirable tapered slot antenna. Accordingly, the tapered slot antenna 10 in the present embodiment is provided with the corrugated structure 16 which is preferably formed within the distance L of 0.65 wavelengths between the tapered portion 14 and the corrugated structure (that is, between the edge of the aperture and the edge of the slot antenna). The intensity of cross-polarized D-plane component increases for the L value of 0.3 wavelengths or less, and this is indicative of the degradation of the antenna characteristics in this range of L, as also as shown in FIG. 3B. The lower limit of the L values is, therefore, preferably 0.3 wavelengths. With this structure, the intensity of cross-polarized D-plane component of the tapered slot antenna 10 is adequately decreased.

According to the results from the two experiments, it is clearly indicated that the desirable tapered slot antenna 10 can be fabricated by providing the corrugated structure 16 which has a slit depth preferably ranging from 0.04 wavelengths to 0.12 wavelengths, more preferably from 0.06 wavelengths to 0.1 wavelengths, and which is formed within the distance of 0.65 wavelengths from the edge of the tapered portion 14. With the present structure, an electric field can be generated so as to counteract to a perpendicular field component to the substrate of the electromagnetic wave radiated from the aperture 15, to thereby be able to reduce the cross-polarized D-plane intensity most efficiently.

Subsequently, in order to measure directivity in each E-, D-, and H-plane, a tapered slot antenna was fabricated according to the first embodiment. Namely, a copper metal layer 13 was disposed having a thickness of about 5 microns, on a polyimide substrate 12 having a thickness of about 50 microns. Subsequently, the antenna was formed, which had an antenna length of 20 millimeters, antenna aperture of 5 millimeters, and distances L between the aperture and slot edge of 2.5 millimeters (0.5 wavelengths). In addition, at the end of both edge portions of the antenna, a corrugated structure was formed having a slit depth d of 0.4 millimeters (0.08 wavelengths), slit width w of 0.2 millimeters (0.04 wavelengths), and pitch of 0.4 millimeters (0.08 wavelengths). Further, the slot antenna was designed for the electromagnetic wave of 60 GHz.

Figure 4A:
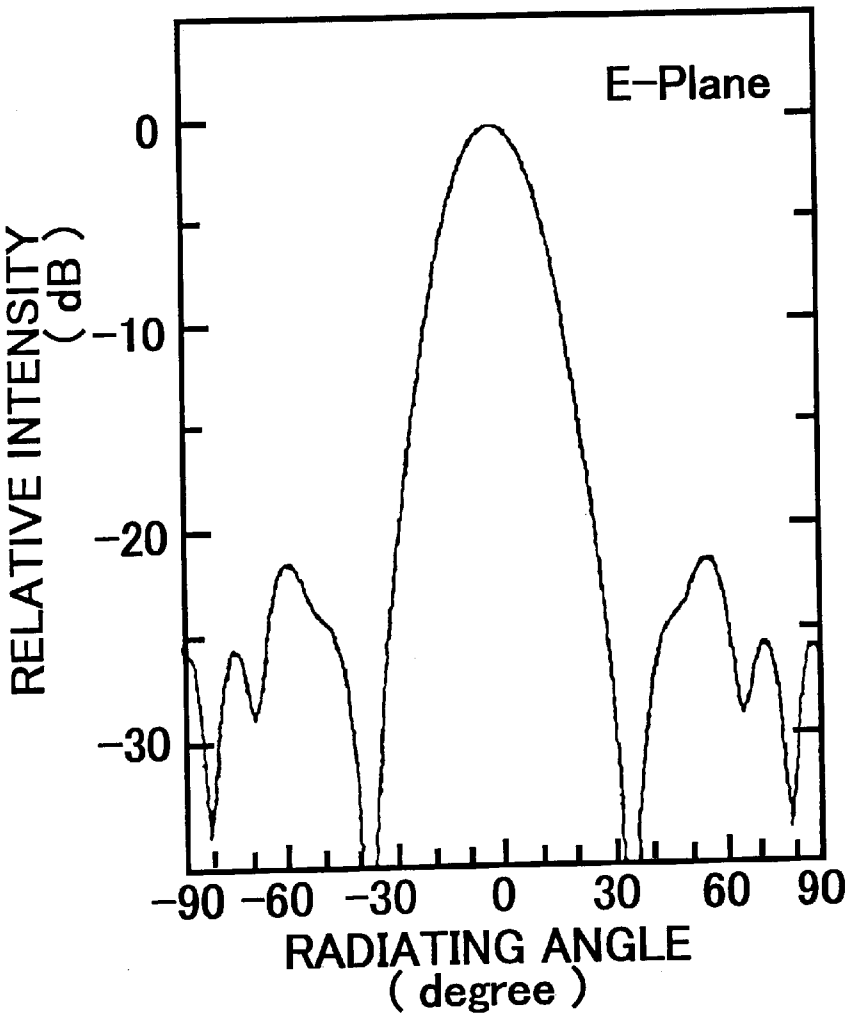
FIGS. 4A, 4B and 4C show the directivity measurement results of the radiation intensity in the E-, H-, and D-planes for a tapered slot antenna according to one embodiment disclosed herein.
Figure 4B:
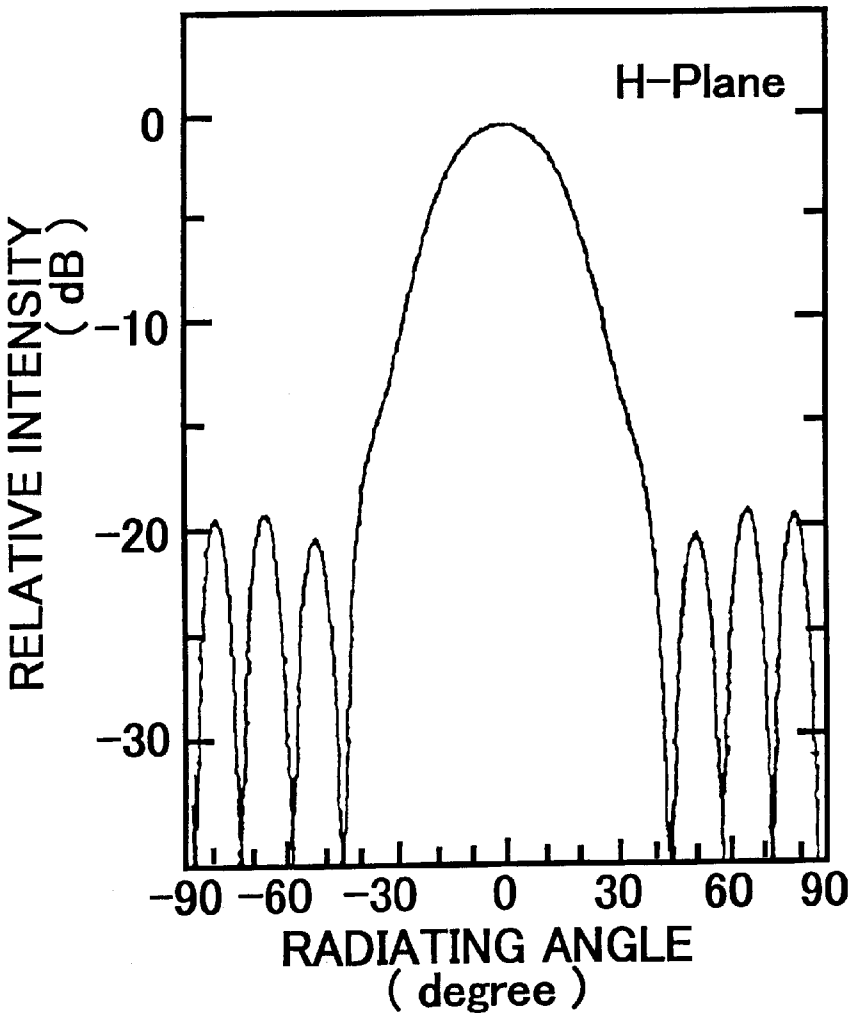
Figure 4C:
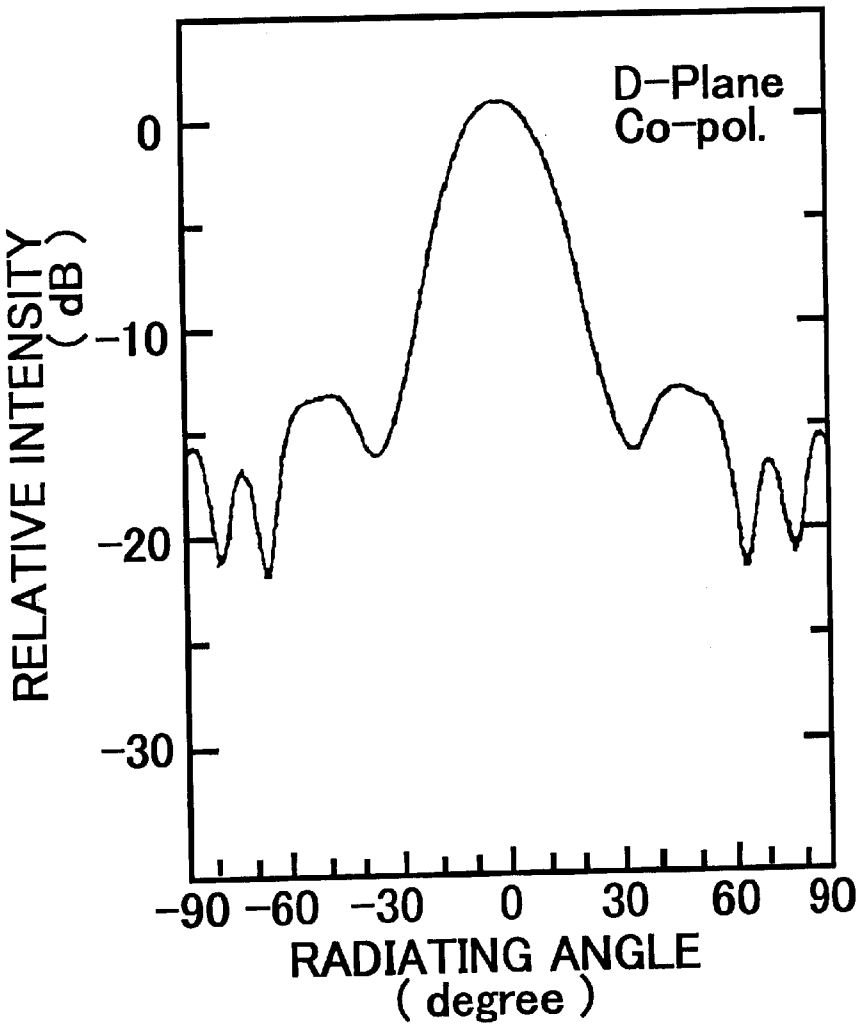
Figure 4D:
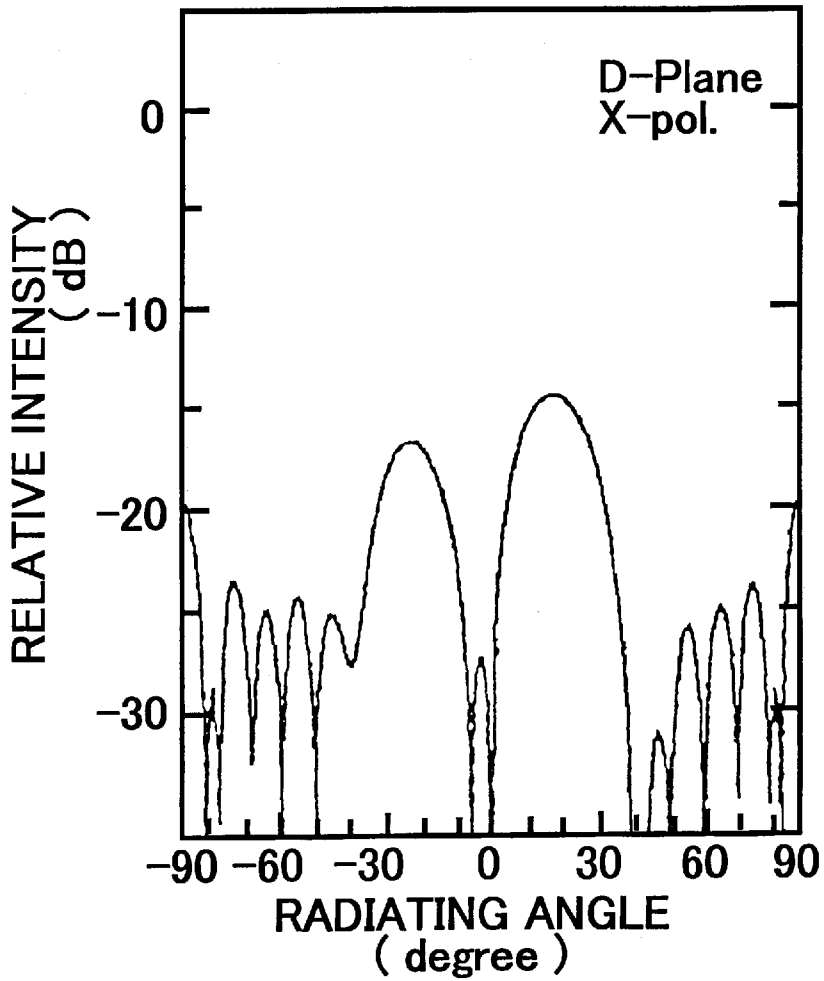
FIG. 4D shows the directivity measurement results of cross-polarized component in the D-plane for a tapered slot antenna according to one embodiment disclosed herein.

The results from the measurements of the directivity of the radiation intensity in the E-, H-, and D-planes are shown in FIGS. 4A, 4B and 4C, respectively. The results of the directivity measurements of cross-polarized component in the D-plane are also shown in FIG. 4D. Throughout FIGS. 4A through 4D, the intensities in dB on the ordinate are plotted versus radiation angles in degrees on the abscissa.

Comparative results from directivity measurements are shown in FIGS. 5A through 5D for a prior antenna without a corrugate structure. These results of the radiation intensity in the E-, H-, and D-planes, and the directivity of the cross-polarized component in the D-plane are shown in FIGS. 5A, 5B, 5C and 5D, respectively in a similar manner to the FIGS. 4A through 4D.

Figure 5B:
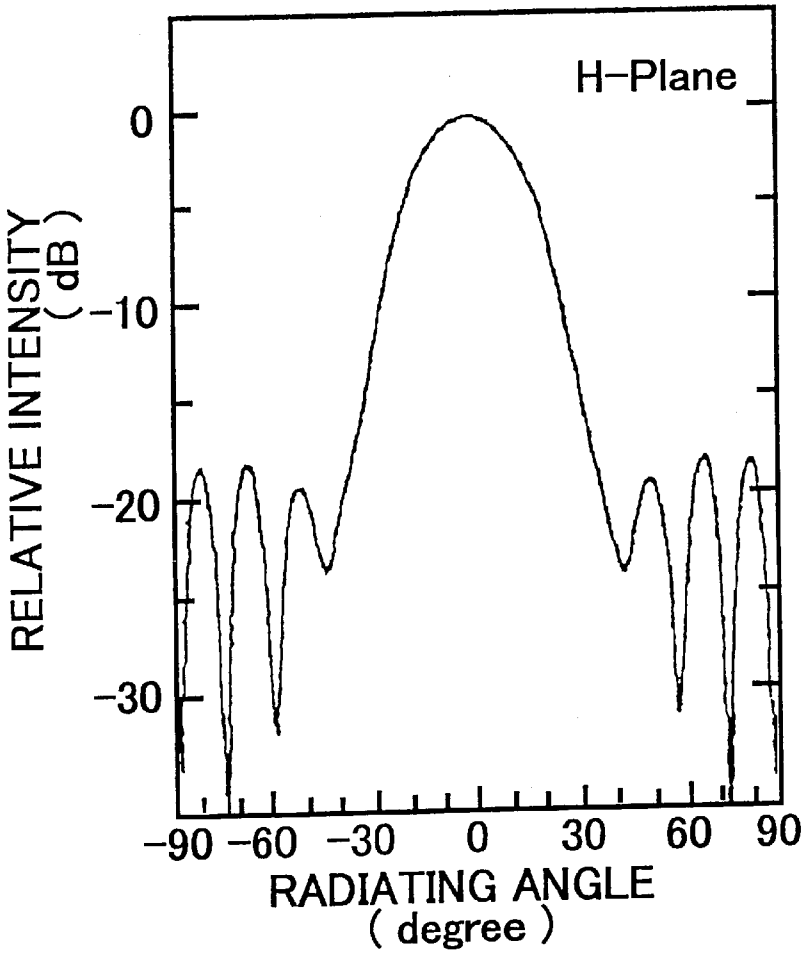
FIG. 5B PRIOR ART
Figure 5C:
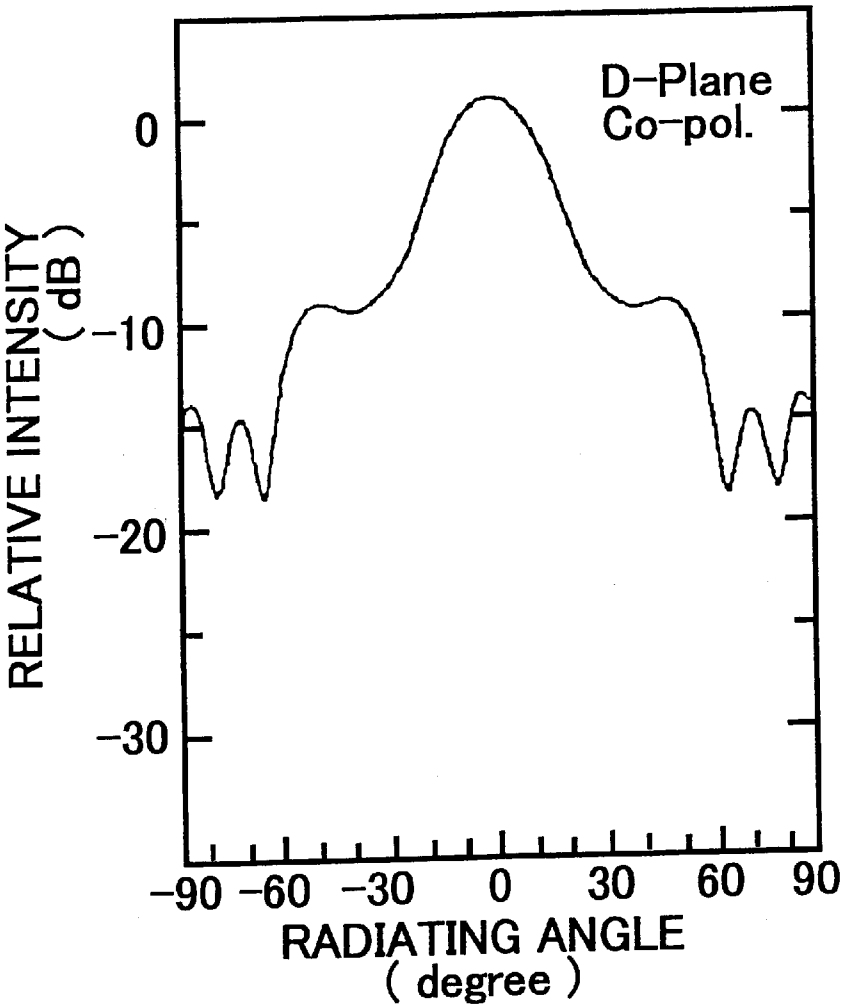
FIG. 5C PRIOR ART
Figure 5D:
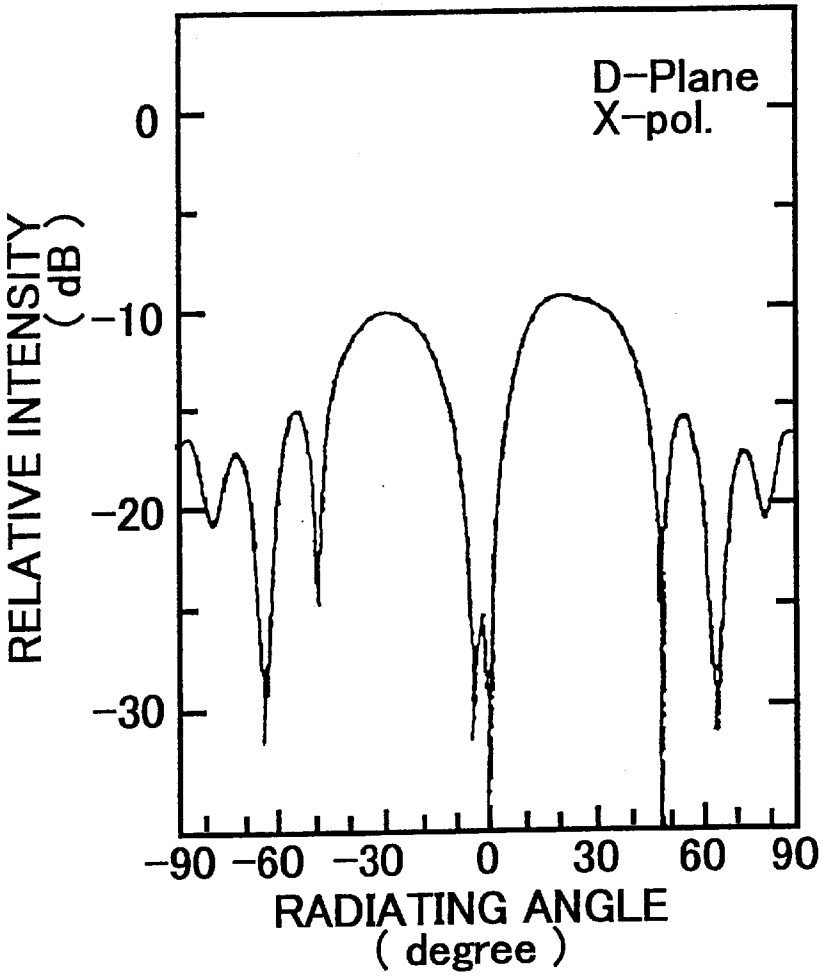
FIG. 5D PRIOR ART
FIG. 5D shows the directivity measurement results of cross-polarized component in the D-plane for a prior tapered slot antenna.

The cross-polarized component in the D-plane for the known antenna is as high as B9 dB as shown in FIG. 5D, while that component for the antenna disclosed herein is obtained as low as B13 dB, as shown in FIG. 4D.

As described above, the tapered slot antenna 10 was formed according to the first embodiment, having the distances L of within 0.65 wavelengths between the edge of the aperture and the outer edge of the substrate. The tapered slot antenna 10 was provided with a, corrugated structure at the end of both edge portions of the substrate 12 parallel to the direction of the radiation, preferably having a slit depth d ranging from 0.04 wavelengths to 0.12 wavelengths, more preferably ranging from 0.06 wavelengths to 0.1 wavelengths. With this structure of the tapered slot antenna, an electric field can adequately be generated so as to counteract to a perpendicular field component of the electric field radiated from the aperture 15, and this enables to adequately reduce the cross-polarized D-plane intensity most efficiently.

Although the shape of slit of the corrugated structure was assumed to be rectangular in the first embodiment, it is needless to say that other slit shapes may also be adopted as long the slits give rise to the similar results as above on the cross-polarized D-plane intensity.

Figure 6A:
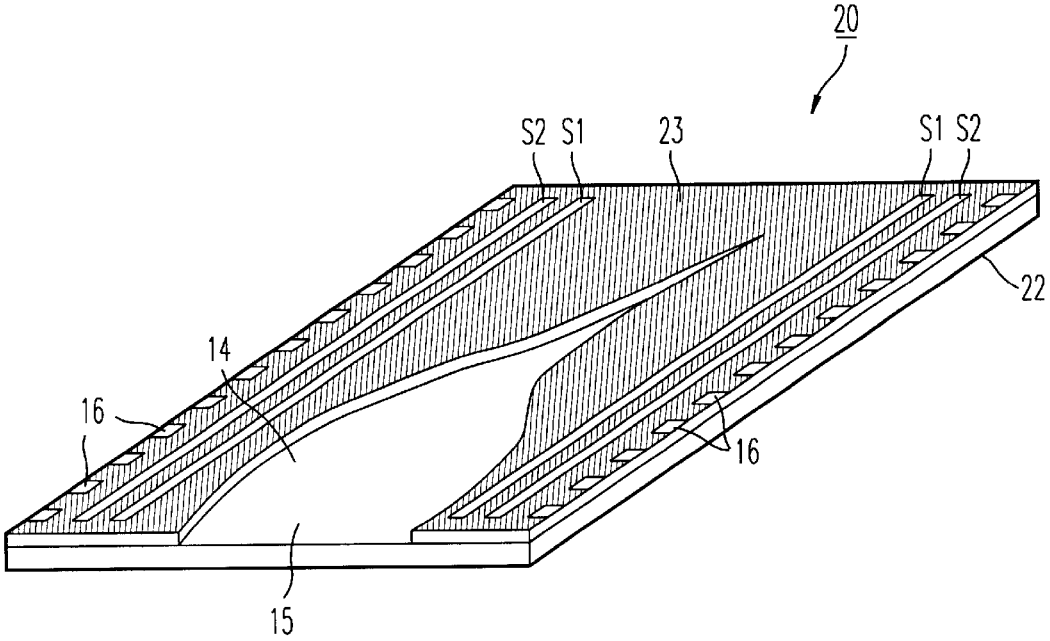
FIGS. 6A and 6B are perspective and top views illustrating a tapered slot antenna, respectively, according to another embodiment disclosed herein.
Figure 6B:
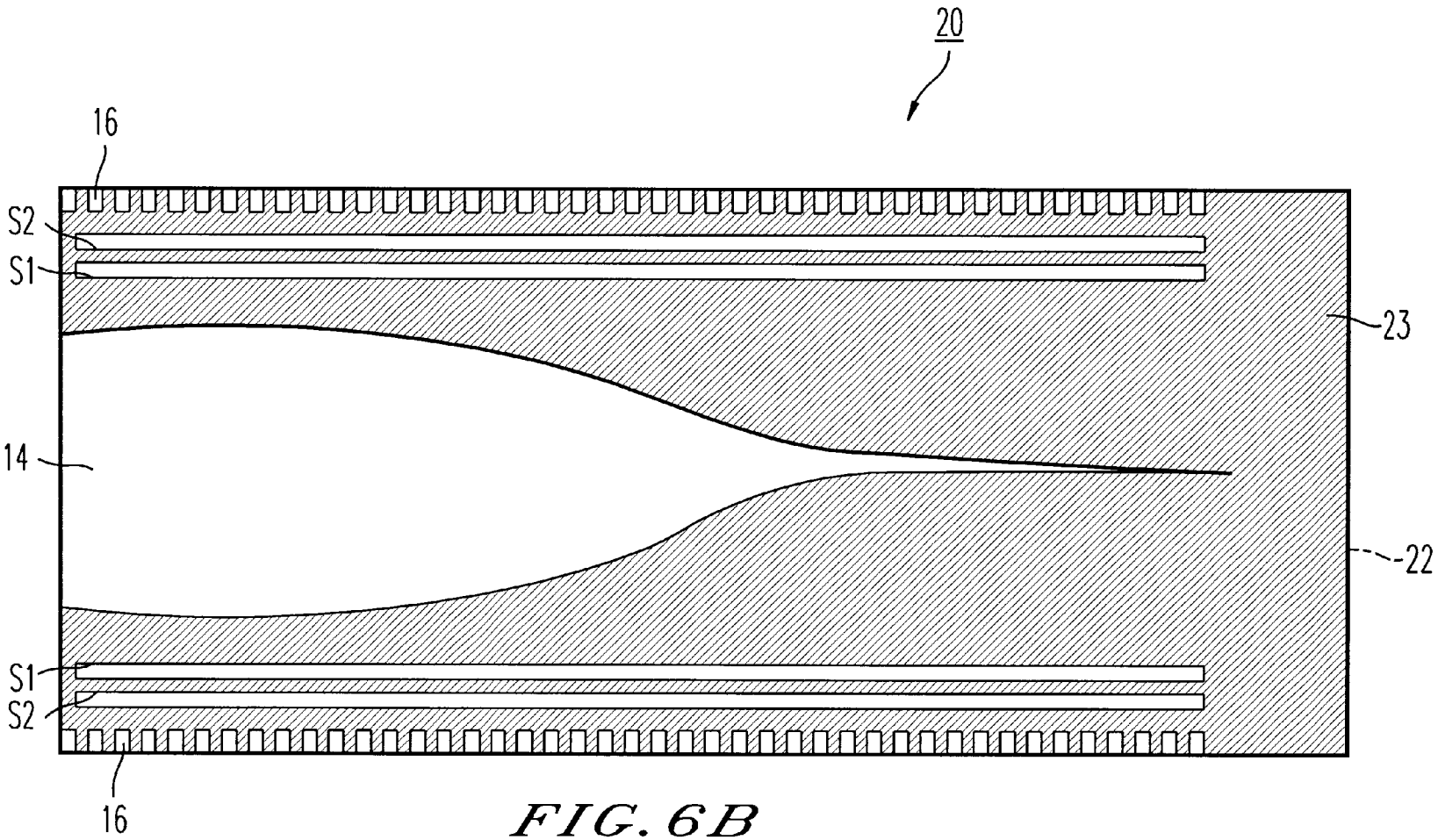

FIGS. 6A and 6B are perspective and top views illustrating a tapered slot antenna, respectively, according to a second embodiment of the invention.

Referring to FIGS. 6A and 6B, a tapered slot antenna 20 comprises a substrate 22 and a metal layer 23 disposed thereon.

The metal layer 23 was subsequently provided with a plurality of linear slits S1, S2 which were formed parallel to the direction of radiation between a corrugated structure 16 and a tapered portion 15. Since the overall structure of the slot antenna 20 is similar to that of the aforementioned antenna 10 except for the slit portions S1, S2, a detailed description on the structure is abbreviated herein.

Figure 7:
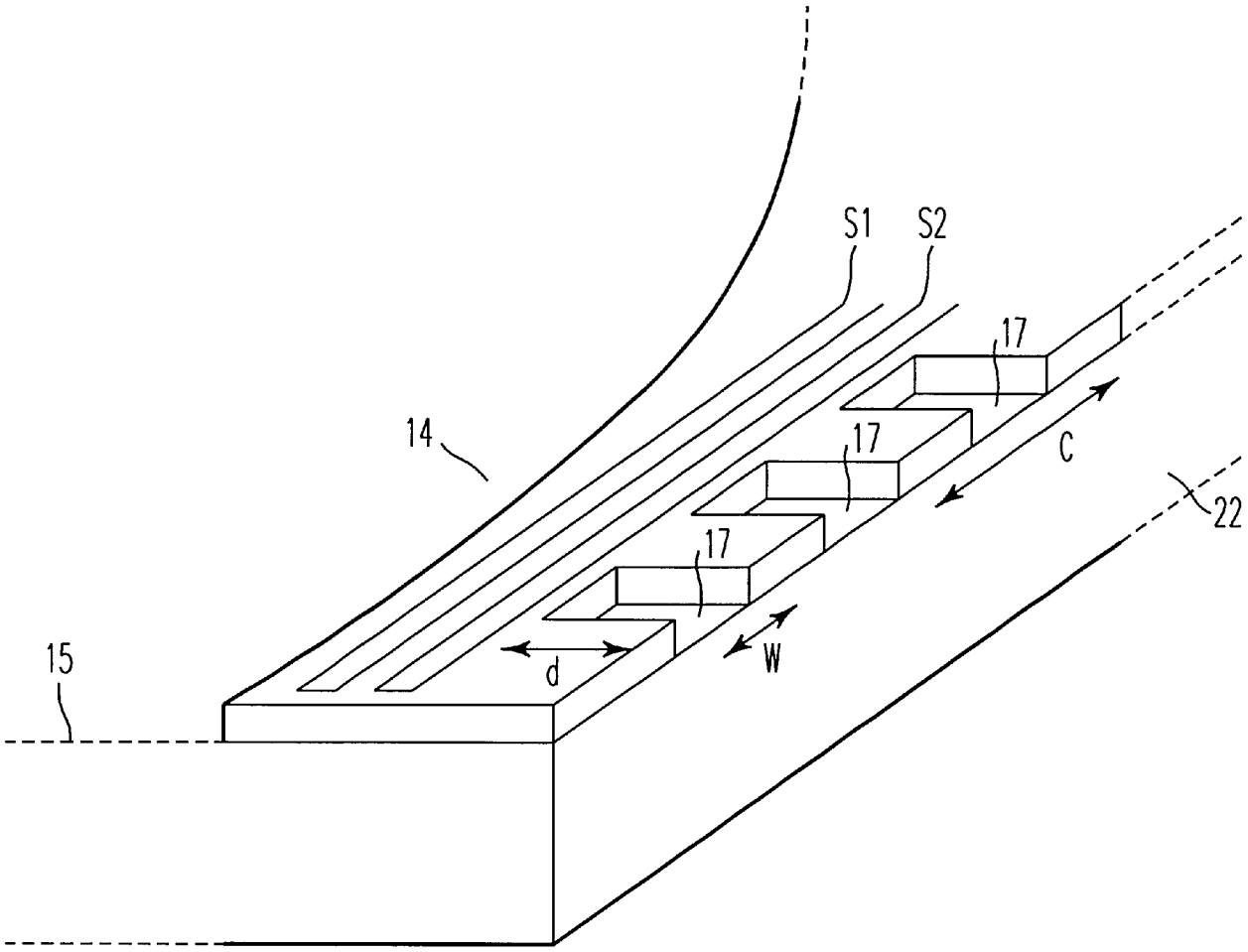
FIG. 7 is an enlarged view of a portion of a tapered slot antenna according to a second embodiment disclosed herein.

FIG. 7 is an enlarged view of a portion of a tapered slot antenna 20 according to the second embodiment.

Referring to FIG. 7, the corrugated structure 16 includes a series of slits 17 cut into the opposing outer edge portions of the metal layer 23. These slits were formed by periodically removing rectangular portions of the metal layer 23. In addition, a plurality of linear slits S1, S2 were formed by etching away to expose portions of the dielectric substrate 22. The linear slits S1, S2 were located between a corrugated structure 16 and a tapered portion 15, approximately in parallel to the direction of electromagnetic radiation and to the edge of the substrate 22.

As described earlier, an adequate electric field is generated intentionally by the tapered slot antenna 10 according to the first embodiment. This electric field is generated in the vicinity of the aperture portion 15 so as to have the phase opposite to that perpendicular field component (i.e., component perpendicular to the substrate) of the electric field radiated from the aperture 15, to thereby offset each other. At the edge of the substrate, however, these two electric field components are in the same phase, thereby being superimposed to increase the intensity. Such increase in the intensity at the substrate edge results in the increase in the crosstalk between neighboring compositional antennas in an antenna array structure.

Accordingly, it is an object of the second embodiment to provide a tapered slot antenna 20 and thereby reduce an electric field intensity at the edge of the substrate by forming linear slits S1, S2 between the corrugated structure 16 and tapered portion 15.

In this context, the use of a corrugated structure for suppressing such an electric filed intensity has been reported by the present inventors and others in the aforementioned publication (IEEE MTT-S International Microwave Symposium Digest, 1998, pages 533–536), in which the corrugated structure is suggested to have a slit depth of preferably at least 0.15 wavelengths.

Figure 8:
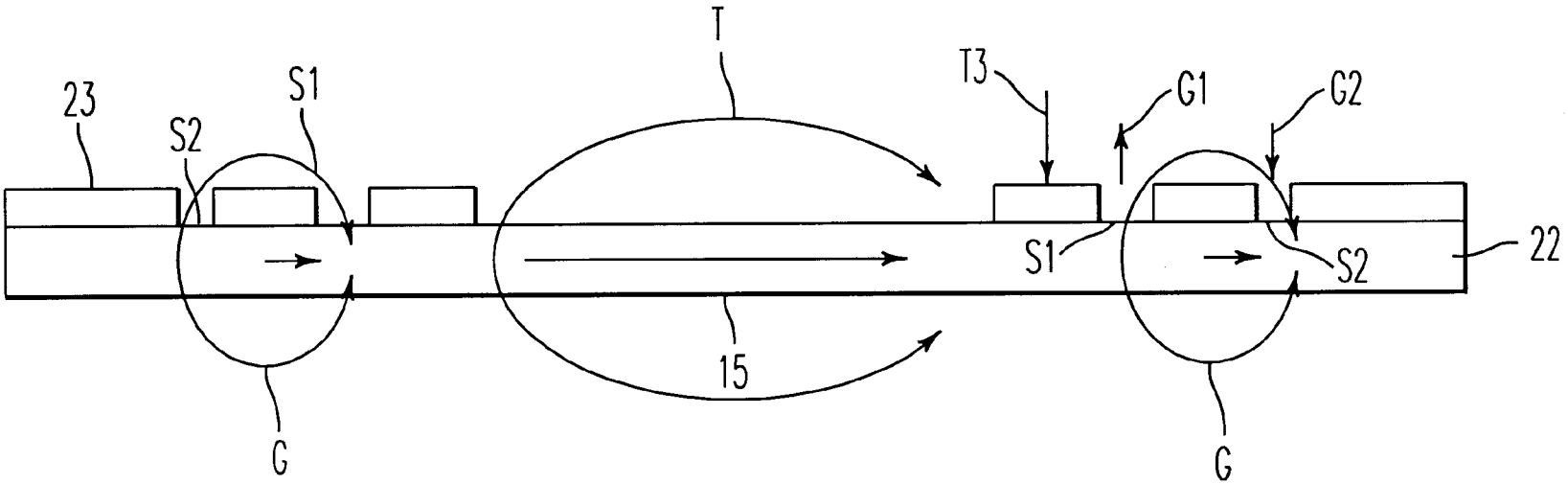
FIG. 8 is a side view illustrating a tapered slot antenna of FIGS. 6A and 6B facing an antenna aperture 15, wherein various field components are shown.

FIG. 8 is a side view of the tapered slot antenna 20 of FIGS. 6A and 6B facing an antenna aperture 15. Referring to FIG. 8, there shown are a transmission mode T in slot line and an electric field G in the slit region. In addition, T3 represents an electric field component generated by the transmission mode T, and G1 and G2 represent each an electric field component perpendicular to the substrate 22, generated by the electric field G. Although the above description of the field component was made for the slits S1, S2 at one end of the substrate, this is also true for the slits at the other end of the substrate.

As indicated in FIG. 8, the components T3 and G1 tend to cancel each other, while T3 and G2 tend to intensify. Since the components T3 and G1 are located spatially close to each other and in the same phase, they cancel each other. In contrast, since the components T3 and G2 are located separated to each other, they are not exactly in the same phase. This causes a slight shift in the phase to thereby result for these components to intensify each other to a certain extent but not complete because of the phase shift. Therefore, the electric field intensity at the end of the substrate can be suppressed and the cross-polarized component in the D-plane can be reduced.

In the present embodiment, the slits may also be formed in a manner other than described above, as long as the desirable slit characteristics are satisfied.

For example, the linear slits may be formed such that the number thereof is more than two, and/or the configuration thereof is not strictly in parallel to the direction of the radiation. In addition, the shape may also be other than linear slit mentioned above, including the combination of various other shapes. Further, the number, and the width and depth, of the slits and the combination thereof may adequately be selected depending on the requirements for the antenna used. Still further, although the shape of the slit 17 of the corrugated structure 16 was described earlier to be rectangular, it is needless to say that other shapes of the slit may also be adopted as long as the slit gives rise to the similar results as indicated earlier.

In order to measure directivity in each E-, D-, and H-plane, a tapered slot antenna was fabricated according to the second embodiment. Namely, a copper metal layer 13 was disposed having a thickness of about 5 microns, on a polyimide substrate 12 having a thickness of about 50 microns. Subsequently, the antenna was formed, which had an antenna length of 20 millimeters, antenna aperture of 5 millimeters, and distances L between the aperture and slot edge of 2.5 millimeters (0.5 wavelengths). In addition, at the end of both edge portions of the antenna, a corrugated structure was formed having a slit depth d of 0.8 millimeters (0.16 wavelengths), slit width w of 0.2 millimeters (0.04 wavelengths), and pitch of 0.4 millimeters (0.08 wavelengths).

Further, between the corrugated structure 16 and a tapered portion 14, linear slits S2 and S1 were respectively formed, having a width of 0.3 millimeters (0.06 wavelengths) located from 1.2 millimeters (0.24 wavelengths) to 1.5 millimeters (0.3 wavelengths) inside the substrate edge, and a width of 0.2 millimeters (0.04 wavelengths) located from 1.8 millimeters (0.36 wavelengths) to 2.0 millimeters (0.4 wavelengths) inside the substrate edge.

Still further, the tapered slot antenna was designed for the electromagnetic wave of 60 GHz.

Figure 9A:
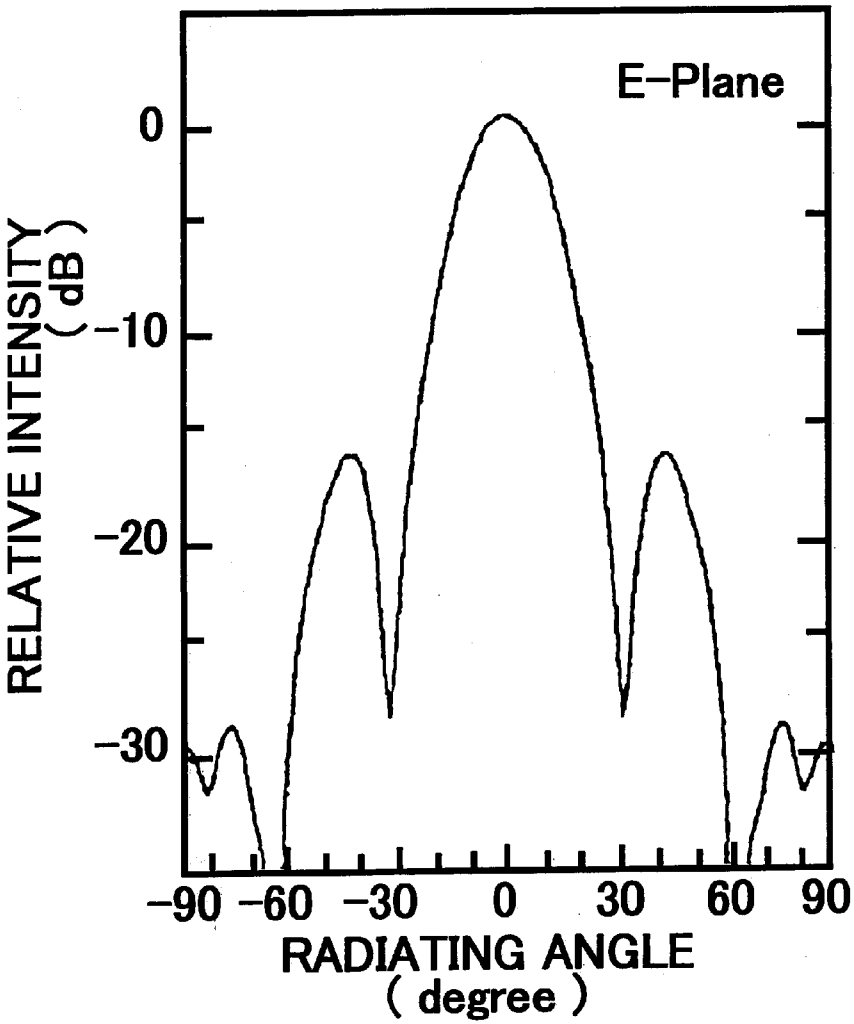
FIGS. 9A, 9B and 9C show the directivity measurement results of the radiation intensity in the E-, H-, and D-planes for a tapered slot antenna according to another embodiment disclosed herein.
Figure 9B:
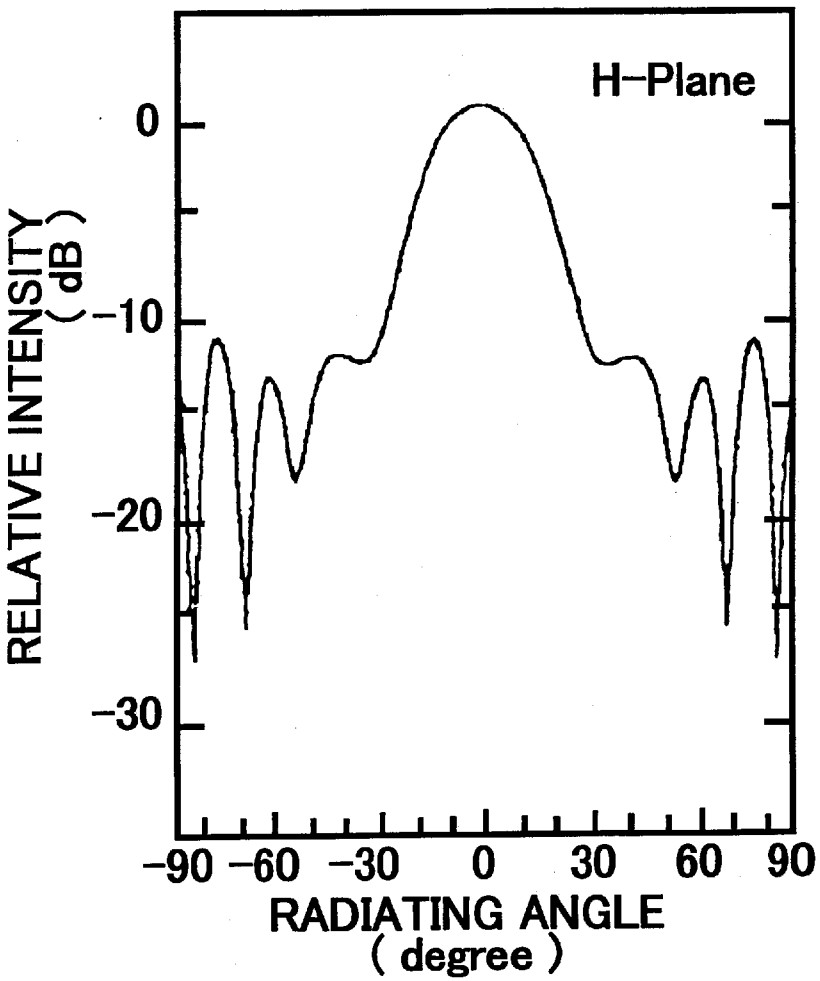
Figure 9C:
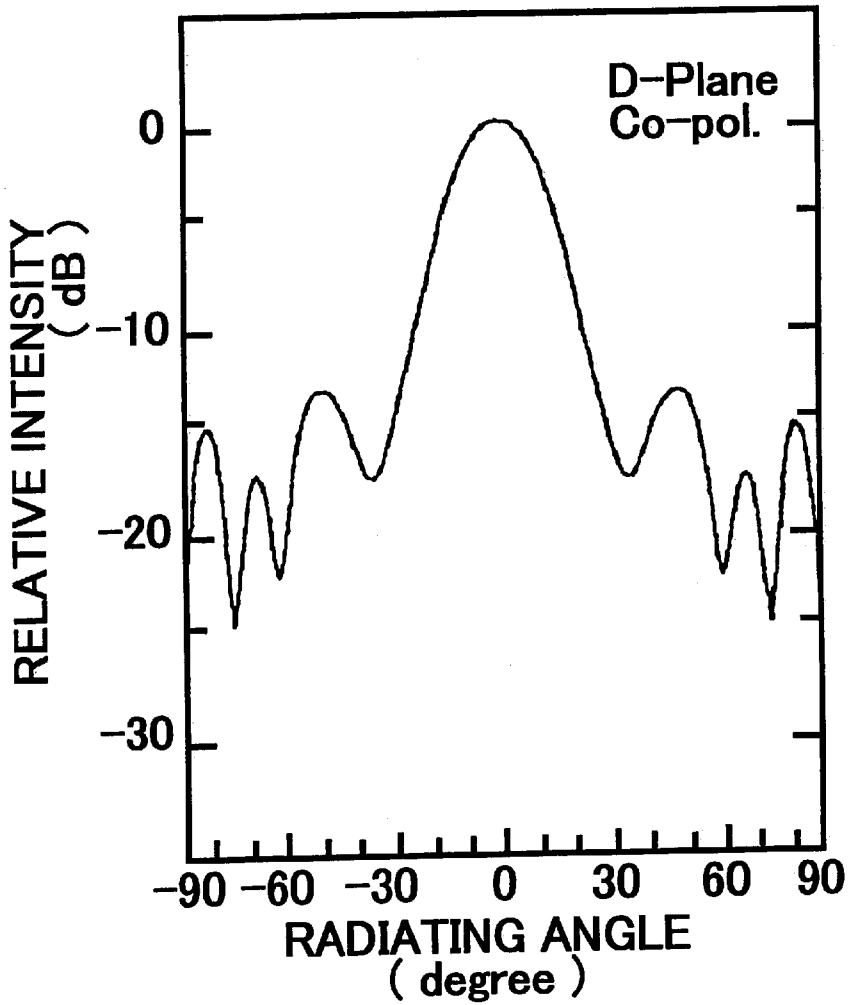
Figure 9D:
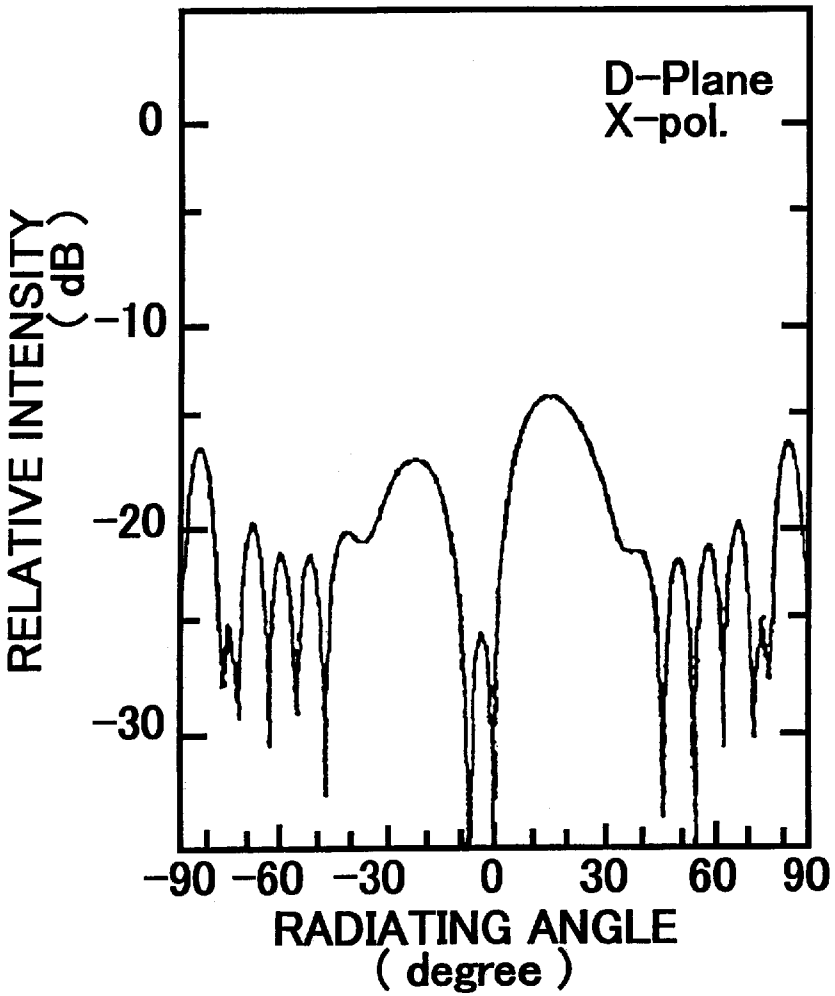
FIG. 9D shows the directivity measurement results of cross-polarized component in the D-plane for a tapered slot antenna according to another embodiment disclosed herein.

The results from the directivity measurements of the radiation intensity in the E-, H-, and D-planes are shown in FIGS. 9A, 9B and 9C, respectively. The results from similar measurements of cross-polarized component in the D-plane are also shown in FIG. 9D. Throughout FIGS. 9A through 9D, the intensities in dB on the ordinate are plotted versus the radiation angle in degrees on the abscissa.

The cross-polarized component in the D-plane for the prior antenna is as high as B9 dB as shown earlier (FIG. 5D), while that component for the antenna disclosed herein is obtained as low as −13.2 dB, as shown in FIG. 9D.

As described above, the tapered slot antenna 20 was formed according to the second embodiment, further provided with the linear slits formed between the corrugated structure and tapered portion; in addition to the corrugated structure formed at the end of both edge portions of the substrate 22, preferably having a plurality of slits 17, each having a depth d of 0.15 wavelengths.

With this structure of the slot antenna, an electric field component can adequately be generated to offset the perpendicular field component of the electric field radiated from the aperture 15. As a result, an undesirable increase in the electric field intensity at the substrate edge portions can be suppressed, and this enables to decrease the aforementioned crosstalk between neighboring compositional antennas. Therefore, the above-mentioned structure can be utilized adequately in an antenna system such as an antenna array composed of a plurality of the antennas disclosed herein.

As disclosed earlier, by generating an electric field having an opposite phase from a portion (as the field generating means) formed within the distance of 0.65 wavelengths from the edge of the tapered portion, the cross-polarized D-plane intensity can efficiently be reduced. This is accomplished with the generated electric field having the opposite phase by counteracting to the electric field component perpendicular to the substrate of the electromagnetic wave radiated from the aperture.

In addition, the electric field generating means may be formed as the corrugated structure in the tapered slot antenna, which includes a plurality of slits formed periodically positioned in opposing outer edge portions of the metal layer parallel to the direction of the radiation and has a depth of the slit ranging from 0.04 wavelengths to 0.12 wavelengths. The electric field is generated by this corrugated structure, having the opposite phase to counteract a perpendicular field component of the electromagnetic wave radiated from the aperture, to thereby be able to reduce the cross-polarized D-plane intensity.

Further, the electric field generating means may also be formed as the combination of the corrugated structure and the plurality of linear slits. As aforementioned, the corrugated structure includes a plurality of slits formed periodically positioned in opposing outer edge portions of the metal layer parallel to the direction of the radiation, having a depth of the slit of the corrugate structure of at least 0.15 wavelengths. In addition, the linear slits are formed in the metal layer between said tapered portion and the corrugate structure parallel to the direction of the radiation. The electric field is generated by this structure, having the opposite phase to counteract the perpendicular field component of the electromagnetic wave radiated from the aperture, to thereby be able to reduce the cross-polarized D-plane intensity.

As a result, an undesirable increase in the electric field intensity at the substrate edge portions can be suppressed, and this enables to decrease the aforementioned crosstalk between neighboring compositional antennas, to thereby be adequately utilized in an antenna system such as an antenna array composed of a plurality of the antennas disclosed herein.

This document claims priority and contains subject matter related to Japanese Patent Application No. 10-375826, filed with the Japanese Patent Office on Dec. 18, 1998, the entire contents of which are hereby incorporated by reference.

Additional modifications to, and variations of, the embodiments described above may be made without departing from the spirit and the scope of the present invention as defined in the appended claims.

What is claimed as new and desired to be secured by Letters Patent of the United States is:

1. A tapered slot antenna comprising:

a substrate having an end; and a metal layer disposed on the substrate, the metal layer having a first outer side, a second outer side, a first inner side, and a second inner side, the first and second inner sides defining a tapered slot having a closed end and an aperture above the end of the substrate, the tapered slot being configured to radiate electromagnetic waves outward from the aperture;

wherein the metal layer includes field generating portions configured to generate an electric field having a phase opposite and counteractive to an electric field component radiated from the aperture and perpendicular to the substrate, the electric field generating portions being located between respective of the first and second inner sides of the metal layer and the first and second outer sides of the of the metal layer;

wherein the electric field generating portions further comprise:

elongated slots defined by the metal layer and extending parallel to the direction of electromagnetic waves radiated from the aperture, the elongated slots being located between respective of corrugated portions and the tapered slot.

2. A tapered slot antenna according to claim 1, wherein the electric field generating portions have a distance from the first outer side to the aperture of less than 0.65 of the wavelength of the electromagnetic waves radiated from the aperture and the distance from the second outer side to the aperture of less than 0.65 of the electromagnetic waves radiated from the aperture.

3. A tapered slot antenna according to claim 1, wherein the electric field generating portions comprise:

corrugated portions formed by a plurality of slits defined by the metal layer along the first and second outer edges of the metal layer, said slits being serially arranged in a direction parallel to the direction of the electromagnetic waves radiated from the aperture.

4. A tapered slot antenna according to claim 3, wherein the slits have a depth of from 0.04 to 0.12 of the wavelength of the electromagnetic waves radiated from the aperture.

5. A tapered slot antenna according to claim 1, wherein the elongated slots have a depth of at least 0.15 of the wavelength of the electromagnetic waves radiated from the aperture.

6. A tapered slot antenna comprising:

a substrate having an end; and a metal layer disposed on the substrate, the metal layer having a first outer side, a second outer side, a first inner side, and a second inner side, the first and second inner sides defining a tapered slot having a closed end and an aperture above the end of the substrate, the tapered slot being configured to radiate electromagnetic waves outward from the aperture;

wherein the metal layer includes field generating portions configured to generate an electric field having a phase opposite and counteractive to an electric field component radiated from the aperture and perpendicular to the substrate, the electric field generating portions being located between respective of the first and second inner sides of the metal layer and the first and second outer sides of the of the metal layer, the distance from the first outer side to the aperture being less than 0.65 of the wavelength of the electromagnetic waves radiated from the aperture, the distance from the second outer side to the aperture being less than 0.65 of the electromagnetic waves radiated from the aperture;

wherein the electric field generating portions further comprise:

elongated slots defined by the metal layer and extending parallel to the direction of electromagnetic waves radiated from the aperture, the elongated slots being located between respective of corrugated portions and the tapered slot.

7. A tapered slot antenna according to claim 6, wherein the electric field generating portions comprise:

corrugated portions formed by a plurality of slits defined by the metal layer along the first and second outer edges of the metal layer, said slits being serially arranged in a direction parallel to the direction of the electromagnetic waves radiated from the aperture.

8. A tapered slot antenna according to claim 7, wherein the slits have a depth of from 0.04 to 0.12 of the wavelength of the electromagnetic waves radiated from the aperture.

9. A tapered slot antenna according to claim 6, wherein the elongated slots have a depth of at least 0.15 of the wavelength of the electromagnetic waves radiated from the aperture.

10. A tapered slot antenna comprising:

a substrate having an end; and a metal layer disposed on the substrate, the metal layer having a first outer side, a second outer side, a first inner side, and a second inner side, the first and second inner sides defining means for radiating electromagnetic waves outward from the aperture, the means for radiating electromagnetic waves having a closed end and an aperture above the end of the substrate;

wherein the metal layer includes plural means for generating an electric field having a phase opposite and counteractive to an electric field component radiated from the aperture and perpendicular to the substrate, the plural means for generating an electric field being located between respective of the first and second inner sides of the metal layer and the first and second outer sides of the of the metal layer;

wherein the plural means for generating the electric field further comprise:

elongated slots defined by the metal layer and extending parallel to the direction of electromagnetic waves radiated from the aperture, the elongated slots being located between respective of corrugated portions and the tapered slot.

11. A tapered slot antenna according to claim 10, wherein the plural means for generating the electric field each have a distance from the first outer side to the aperture of less than 0.65 of the wavelength of the electromagnetic waves radiated from the aperture and the distance from the second outer side to the aperture of less than 0.65 of the electromagnetic waves to radiated from the aperture.

12. A tapered slot antenna according to claim 10, wherein the plural means for generating the electric field comprise:

corrugated portions formed by a plurality of slits defined by the metal layer along the first and second outer edges of the metal layer, said slits being serially arranged in a direction parallel to the direction of the electromagnetic waves radiated from the aperture.

13. A tapered slot antenna according to claim 12, wherein the slits have a depth of from 0.04 to 0.12 of the wavelength of the electromagnetic waves radiated from the aperture.

14. A tapered slot antenna according to claim 10, wherein the elongated slots have a depth of at least 0.15 of the wavelength of the electromagnetic waves radiated from the aperture.

15. A tapered slot antenna comprising:

a substrate having an end; and a metal layer disposed on the substrate, the metal layer having a first outer side, a second outer side, a first inner side, and a second inner side, the first and second inner sides defining means for radiating electromagnetic waves outward from the aperture, the means for radiating electromagnetic waves having a closed end and an aperture above the end of the substrate;

wherein the metal layer includes plural means for generating an electric field having a phase opposite and counteractive to an electric field component radiated from the aperture and perpendicular to the substrate, the plural means for generating an electric field being located between respective of the first and second inner sides of the metal layer and the first and second outer sides of the of the metal layer, the distance from the first outer side to the aperture being less than 0.65 of the wavelength of the electromagnetic waves radiated from the aperture, the distance from the second outer side to the aperture being less than 0.65 of the electromagnetic waves radiated from the aperture;

wherein the plural means for generating the electric field further comprise:

elongated slots defined by the metal layer and extending parallel to the direction of electromagnetic waves radiated from the aperture, the elongated slots being located between respective of corrugated portions and the tapered slot.

16. A tapered slot antenna according to claim 15, wherein the plural means for generating the electric field comprise:

corrugated portions formed by a plurality of slits defined by the metal layer along the first and second outer edges of the metal layer, said slits being serially arranged in a direction parallel to the direction of the electromagnetic waves radiated from the aperture.

17. A tapered slot antenna according to claim 16, wherein the slits have a depth of from 0.04 to 0.12 of the wavelength of the electromagnetic waves radiated from the aperture.

18. A tapered slot antenna according to claim 15, wherein the elongated slots have a depth of at least 0.15 of the wavelength of the electromagnetic waves radiated from the aperture.

* * * * *